United States Patent [19]

Francis, Jr. et al.

[11] 4,448,616

[45] May 15, 1984

[54] PROCESS FOR REDUCING BACKMIXING

[75] Inventors: Arthur W. Francis, Jr., New City; Mark S. Nowotarski, Ossining; Jack Solomon, Rye, all of N.Y.

[73] Assignee: Union Carbide Corporation, Danbury, Conn.

[21] Appl. No.: 382,201

[22] Filed: May 26, 1982

Related U.S. Application Data

[63] Continuation-in-part of Ser. No. 284,681, Jul. 20, 1981, abandoned.

[51] Int. Cl.[3] ..... F27B 3/22; F27D 7/00; F23M 11/02

[52] U.S. Cl. ..... 148/16; 266/44; 432/22; 432/64; 110/179

[58] Field of Search ..... 148/16; 432/22, 64; 266/44; 110/179

[56] References Cited

U.S. PATENT DOCUMENTS

| | | | |
|---|---|---|---|
| 1,725,059 | 8/1929 | Colby | 432/64 |
| 1,803,007 | 12/1956 | Dreffein | 432/22 |
| 2,775,216 | 12/1956 | Alexeff et al. | 110/179 |
| 2,823,629 | 2/1958 | Wittke | 110/179 |
| 3,039,407 | 6/1962 | Daman | 110/179 |
| 3,142,272 | 7/1964 | Phillips et al. | 110/179 |
| 3,223,396 | 12/1965 | Thompson | 266/5 |
| 3,397,874 | 8/1968 | Augustine | 432/22 |
| 3,931,684 | 1/1976 | O'Hara et al. | 34/242 |
| 4,150,494 | 4/1979 | Rothchild | 34/28 |
| 4,298,341 | 11/1981 | Nowack | 432/64 |

*Primary Examiner*—Veronica O'Keefe
*Attorney, Agent, or Firm*—Saul R. Bresch

[57] ABSTRACT

This invention relates to a process for substantially reducing the backmixing or backflow of gases into metal heat treating furnaces by the use of a particular gas jet and a defined flow rate.

2 Claims, 2 Drawing Figures

PROCESS FOR REDUCING BACKMIXING

This application is a continuation-in-part of Ser. No. 284,681 filed July 20, 1981, now abandoned.

DESCRIPTION OF THE PRIOR ART

Industrial processes commonly use controlled atmospheres in furnaces that are more or less open to gases of a different composition, usually atmospheric air. A typical way in which these foreign gases can enter a furnace is when exit gases from a hot furnace rise as they pass into the atmosphere thus allowing other cooler gases, such as atmospheric air, to creep into the furnace along the floor. Controlling the atmosphere, among other things, involves the exclusion, reaction, and/or dilution of infiltrating gases so that the desired gas composition is achieved and maintained in the furnace. In the past, this has been accomplished, alternatively, by the use of relatively high flow rates; with flame curtains or brushes, which lower the required atmospheric flow; or through the judicious introduction of auxiliary gases, inert to the process being carried out, via, for example, gas jets.

The gas jet technique appears to be the most promising, particularly for those processes, which commonly use open-ended furnaces such as hardening of steel; powder metal sintering; tube, rod, and stainless steel annealing; molten metal pouring; and steel brazing. Many other processes would also be expected to benefit from the use of gas jets but, in some cases, the furnace opening is so large that impractically high flows of gases cannot be avoided. In other cases, a very expensive atmosphere may be needed in one furnace zone or during one phase of the process, yet less expensive atmospheres are permissible in other zones or in other phases of the process. For example, stainless steel brazing requires a high hydrogen content atmosphere, disassociated ammonia, or pure hydrogen. Once the steel has been cooled, however, an inert atmosphere, e.g., nitrogen, is satisfactory. Frequently, in the case of high hydrogen content atmospheres, specially designed furnaces are used to limit the flow rate and increase safety. These "humpback" furnaces are expensive and create an operating problem.

Gas jets, as presently contemplated, however, have not been able to substantially exclude foreign gases from the furnace and, at the same time, meaningfully reduce atmosphere flow rates; eliminate the need for special furnace designs; accommodate different atmospheres and temperatures in adjacent furnace zones; or overcome the problem posed by furnaces with large openings.

SUMMARY OF THE INVENTION

An object of this invention, therefore, is to provide an improvement in gas jet technology insofar as open-ended furnaces are concerned whereby the infiltration of undesirable gases into the furnace will be substantially circumscribed concommitantly with a reduction in flow rates; elimination of special designs; increased versatility in attaining different atmospheres and temperatures in adjacent zones; and/or overcoming the large opening problem.

Other objects and advantages will become apparent hereinafter.

According to the invention, such an improvement has been discovered in a process for preventing the backmixing of gases into a metal heat treating furnace having two ends, one or both of said ends having openings; each of said openings being defined by its dimensions of width and height and having a gas jet positioned in said opening in such a manner that at least part of the gases is prevented from backmixing into the furnace.

The improvement comprises preventing substantially all of said gases from backmixing into the furnace by carrying out the following steps:

(a) constructing the gas jet by providing a row of uniformly distributed holes in the wall of a straight tube, said row of holes being about parallel to the hypothetical axis running through the center of the tube from one end of the tube to the other end, the ratio of the distance between any two adjacent holes to the height of the opening being no greater than about 1:6;

(b) positioning the gas jet at about the top, and across the width, of at least one opening, the holes being pointed into the furnace in such a direction that a hypothetical line drawn through the center of each hole from, and perpendicular to, the axis of the gas jet would be at an angle in the range of about 0 to about 110 degrees as measured from a hypothetical line corresponding to the height dimension of the opening; and (c) introducing a gas through each gas jet at a flow rate through said gas jet, which is (i) about equal to or greater than the value determined by the following formula when the furnace has one opening and (ii) about equal to the value determined by the following formula when the furnace has two openings:

$$\sqrt{\frac{(A-B)(g)(D)(E)(F)^2(G)}{C}} \times \frac{H}{1.0} \times \frac{300}{J}$$

wherein:

A = density of ambient air
B = density of furnace gases at the opening for said gas jet
C = density of jet gas
g = acceleration of gravity
D = total area of holes in said gas jet
E = width of said opening
F = height of said opening
G = about 1 to about 5
H = the pressure in number of atmospheres inside the gas jet
J = the temperature in degrees Kelvin inside the gas jet Note: The flow rate is expressed in volume per unit time at standard conditions of 300° Kelvin and 1 atmosphere pressure.

DESCRIPTION OF THE PREFERRED EMBODIMENT

Figure 1:
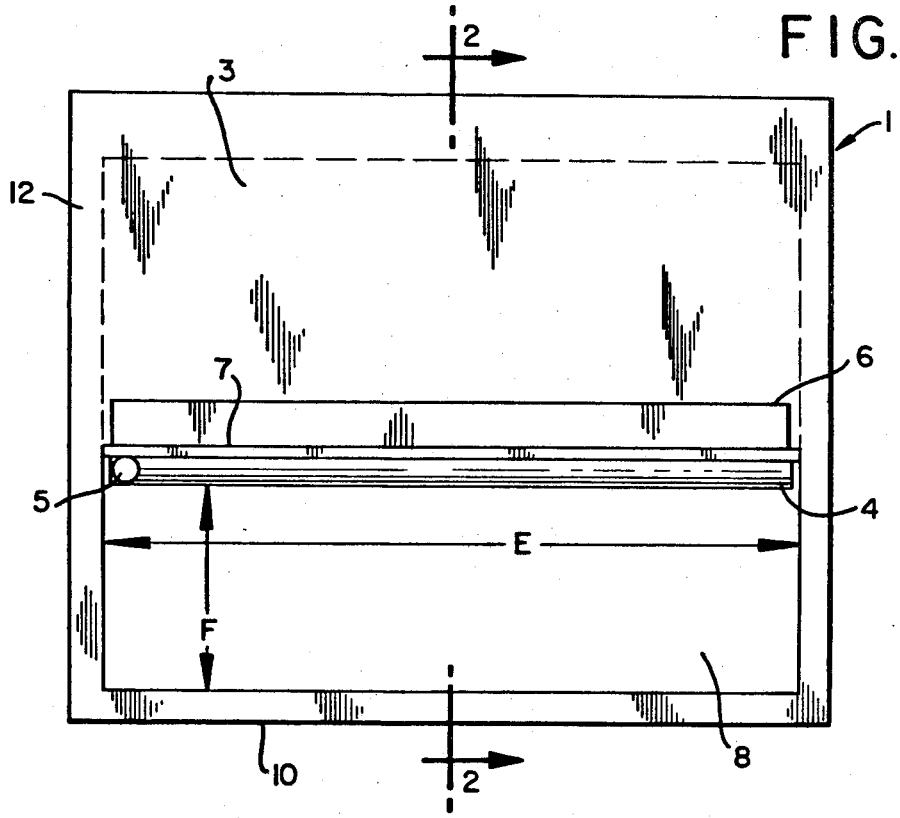
FIG. 1 is a schematic diagram of a partial front view (inlet end) of an open-ended continuous heat treating furnace in which the process of the invention can be carried out.

The open-ended furnace of concern here as well as the underlying processes are those conventially used for various forms of metal heat treating such as carburizing, hardening, annealing, powder metal sintering, brazing, and pouring. A discussion of carburizing and metal sintering, for example, and the furnaces in which these processes may be carried out, can be found in U.S. Pat. Nos. 4,139,375 and 4,145,232. Material on conventional single and double open-ended furnaces may be found in the "Powder Metallurgy Equipment Manual" prepared by the Powder Metallurgy Equipment Association and published by the Metal Powder Industries Federation at Princeton, N.J., in 1977. Subject process deals with just one part of the furnace, however, i.e., the opening at one end which serves as the inlet and outlet for the metal workpieces, referred to as the single open-ended furnace, and the openings at the inlet end and at the outlet end of those furnaces referred to as double open-ended furnaces.

Figure 2:
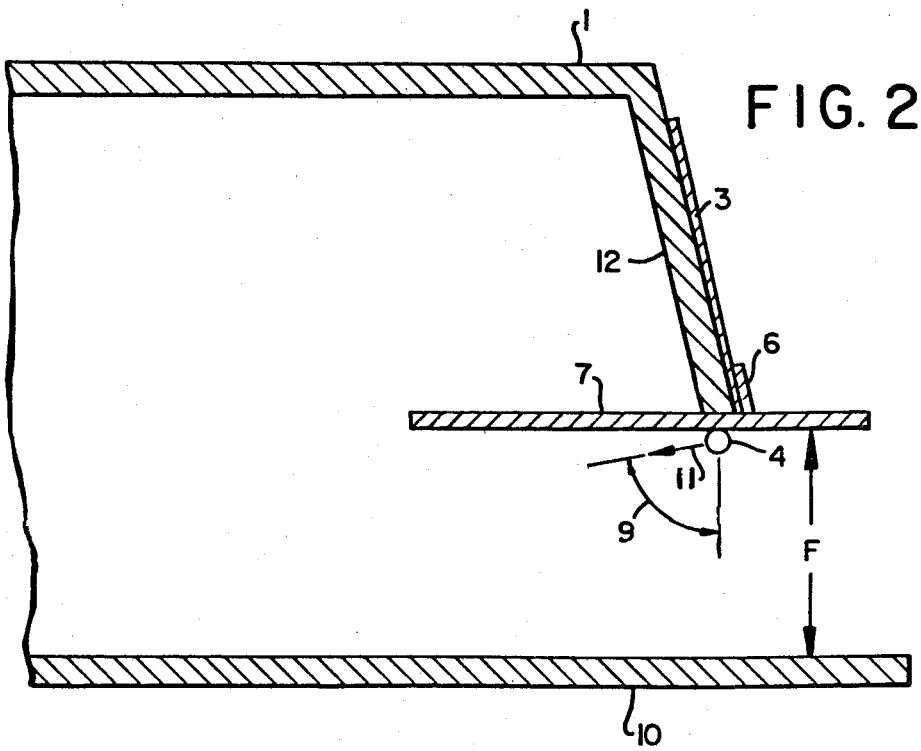
FIG. 2 is a schematic diagram of a partial cross-section taken at 2—2 of FIG. 1 showing the front end of the furnace.

Referring to the drawing:

FIG. 1 is an embodiment of one end of an open-ended furnace. It can represent the one open end of the single open-ended furnace or either end of the double open-ended furnace. The only details, which are shown in the drawing, are those which bear directly on subject process, and these, advantageously, are few. Furnace 1 is, of course, the conventional furnace made of refractory and steel. Door 3 is shown in the raised or open position against furnace end wall 12. It will be understood that conventional furnaces do not necessarily have doors. In any case, subject process is used either where there is no door or when the door is open. The dimensions of opening 8 are represented by dimension E (width) and dimension F (height). Furnace floor 10, which can be stationary or in belt form for a continuous operation, completes those details, which can be considered standard for open-ended metal heat treating furnaces. While, as previously noted, gas jets are known, the particular construction and positioning of gas jet 4 are not. On the other hand, feed line 5, which is used for the delivery of gas to gas jet 4, represents piping which would conventionally be used to transport gas in similar situations. Mounting plate 6 is also conventional in its function while horizontal plate 7 has a function which enhances subject process. These features are discussed below. The same details are shown in FIG. 2 with some additions. The direction of the gas as it leaves gas jet 4 is shown by arrow 11 and jet angle 9 is also shown.

Gas jet 4 can be described as a cylindrical tube with a hypothetical axis running from the center of one end of the cylinder to the center of the other end of the cylinder. This axis corresponds to the fixed straight line around which the surface of the cylinder can be traced, by geometrical definition. While the diameter of the tube is not critical, it will be understood that very thin tubes will not provide an even distribution of gas. Tubes of other shapes can be used although the cylindrical tube is preferred because it can be more readily positioned to drive the gas at the desired angle. The jet can be formed by drilling holes along a line or in a row parallel to the hypothetical axis. The holes should be uniformly distributed along the tube to avoid an unbalanced condition such as, for example, a situation where all of the holes are on one side of the tube. These holes are preferably equally spaced from one another, the distance between any two adjacent holes being no greater than about one inch and preferably in the range of about 0.1 inch to about 0.6 inch. The phrase "the distance between any two adjacent holes" contemplates the use of a single slot instead of a row of holes. The "distance" is measured from center point to center point in the case of circular and square holes and the equivalent in the case of holes of other shapes. The objective is to get an essentially complete slot jet effect. For an opening greater than 3 inches, 0.25 inch spacing is found to give an excellent slot jet effect with 0.125 inch spacing an even better effect in some cases. The number of holes is determined by the width of opening 8, i.e., dimension E, and the spacing of the holes. The ratio of the distance between any two adjacent holes to the height of the opening should be no greater than about 1:6. The diameter of each hole can be in the range of about 0.005 inch to about 0.1 inch and is preferably in the range of about 0.01 inch to about 0.07 inch. The holes can have a shape other than circular, square, for example. Also, as noted, a slot can be substituted for the entire row of holes or a few slots can be used. Larger holes need more flow and so are less economical. An optimum combination for openings greater than 3 inches is 0.5 inch spacing with 0.02 inch diameter holes. It will be understood that a series of nozzles with or without a manifold or another type of sparger, using the same spacing and diameters, can be substituted for the perforated tube. Such arrangements, however, increase cost, but not performance.

Gas jet 4, as constructed, is then positioned at about the top of opening 8. It can be affixed directly to the top of the opening, to horizontal plate 7, or the bottom of door 3, which will bring it to the top of opening 8 when door 3 is in the open position. Positioning is as close to the top of opening 8 or to horizontal plate 7 as is physically possible. The placement is such that gas jet 4 lies across the width of opening 8, i.e., running from side wall to opposite side wall so that its axis is about perpendicular to dimension F and about parallel to dimension E. In most cases, dimension F runs vertically while dimension E runs horizontally as does furnace floor 10. The row or line of holes, which, as noted, is parallel to the axis of gas jet 4 is then turned until each hole is pointed into the furnace in such a direction that a hypothetical line drawn through the center of the hole from, and perpendicular to, the axis of gas jet 4 is at an angle of about 0 degree to about 110 degrees as measured from a hypothetical line corresponding to the height dimension, i.e., dimension F. As noted, this line (corresponding to dimension F) is usually vertical, i.e., perpendicular to floor 10. A preferred angle is in the range of about 45 degrees to about 90 degrees, the direction of gas flow being towards the zone where the gas density is relatively lower. When jet 4 is positioned as described, and the flow rate is as determined below, the gas will proceed in the direction exemplified by arrow 11. Ninety degrees is considered to be the optimum angle.

Subject process is such that the gas used in the gas jet as directed will essentially not backmix into the zone(s) of the furnace where the heat treating is being effected. It is apparent that the process can be used for any volume where atmosphere is controlled including the various zones within a furnace or volume. The term "furnace" is, therefore, considered to encompass volume and zone as understood by those familiar with the art of heat treating. The opening, for the purpose of subject process, is the opening into the zone. Since the gas will not disturb or have a deleterious effect on the controlled atmosphere, almost any gas can be used in the gas jet. Gases which would be unsafe or corrosive are, of course, proscribed. Preferred gases selected for introduction into the furnace through gas jet 4 are those which are compatible with the furnace atmosphere required for the particular heat treating process being utilized. Examples of gases which may be used are nitrogen, helium, argon, natural gas, and, in some cases, even air. It is found that helium requires higher flow rates than natural gas; natural gas higher than nitrogen; nitrogen higher the air; and air higher than argon or carbon dioxide.

The gas is introduced through gas jet 4 at a flow rate for said gas jet, which is about equal to or greater than the value determined by the following formula when the furnace has one opening. When the furnace is a double open-ended one, however, the flow rate is about equal to the value determined by the following formula. The term "about" is considered to allow for a variance in flow rate of plus or minus about ten percent.

The formula is as follows:

$$\sqrt{\frac{(A-B)(g)(D)(E)(F)^2(G)}{C}} \times \frac{H}{1.0} \times \frac{300}{J}$$

wherein:

A=density of ambient air
B=density of furnace gases at the opening for said gas jet
C=density of jet gas
g=acceleration of gravity
D=total area of holes in said gas jet
E=width of said opening
F=height of said opening
G=about 1 to about 5
H=the pressure in number of atmospheres inside the gas jet
J=the temperature in degrees Kelvin inside the gas jet As noted, the process is carried out at each opening of the double open-ended furnace without regard to the other opening, the flow rate for each opening being determined independently from the other. Of course, where the flow of external gases is restricted at one opening, the furnace is then considered to be a single open-ended furnace and treated accordingly.

The densities for ambient air, furnace gases, and jet gas are determined by the following formula:

$$\text{density} = \frac{KL}{MN}$$

wherein

K=molecular mass of gas
L=pressure
M=universal gas content
N=absolute temperature As any of these densities change, the value determined by the formula will change, and the flow rate will have to be changed accordingly. The acceleration of gravity is $4.15\times10^8$ hour per hour or 9.8 meters per second per second. The total area of the holes in the gas jet is obtained by multiplying the number of holes times the area of each hole. The width is dimension E while the height is dimension F. G is a parameter describing jet performance. It is determined that to provide an effective jet the parameter G should be in the range of about 1 to about 5. While an angle correction factor may be used in the formula which would increase from about 1 to about 1.3 as the angle varies from 90 degrees (straight into the furnace) to 0° (straight down), it is considered that this factor is not sufficiently meaningful. It should be pointed out, however, that although the flow rate is affected very little by choice of angle, the overall effectiveness of the jet does diminish as the jet is pointed straight down.

Mounting plate 6 is attached to the bottom of door 3, or directly to the top of the opening, to facilitate the attachment of horizontal plate 7 and gas jet 4. As can be seen in FIG. 2, mounting plate 6 is located across the width of the lowest part of door 3. It has no other function. Horizontal plate 7, on the other hand, enhances the action of the gas jet particularly when plate 7 extends a distance at least about equal to the height of the opening (dimension F) into the furnace. This is the case for both single and double open-ended furnaces. As noted, the double open-ended furnace can be converted into a single open-ended furnace for the purposes of subject process by placing a flow restricting apparatus, typically one or two curtains or brushes, over the outlet opening.

The flow rate used in the single open-ended furnace has no upper limit. Those knowledgeable in the art will consider that there are bounds of practicality based on economic considerations and the limitations of available apparatus, however. In the case of non-rectangular openings, e.g., trapezoidal or circular openings, the greatest width and height dimensions are used. The opening can also be divided into rectangular sections, and jets used to accommodate each section. In the case of an opening of narrow width in a furnace of greater width, side plates can be used, extending into the furnace from the sides of the opening, to increase the effectiveness of the jet. The side plates will run parallel to the side walls of the furnace. Subject process, insofar as the double open-ended furnace is concerned, assumes that the room in which the furnace is located is quiescent, i.e., there are essentially no external winds or drafts. In the event that the room is not quiescent, the calculated flow rate for the gas jet facing the wind, i.e., the gas jet in the opening on the downwind side of the furnace, will have to be adjusted upward to compensate for the dynamic pressure of the wind. In the double open-ended furnace, the gas jet which is facing in the direction in which the wind is blowing, i.e., the gas jet in the opening on the upwind side of the furnace, and single open-ended furnaces are not affected by the external wind.

Similarly, if the bottom of the openings of the furnace are not at the same level, then, the flow rate in the higher opening is increased to compensate for the increased buoyancy pressure at that opening. The flow rate for the lower opening, however, is unaffected.

The invention is illustrated by the following example:

EXAMPLE

The above described process is carried out under preferred conditions in a conventional single open-ended furnace using the apparatus described above in the drawing. The door opening has a height above in the drawing. The door opening has a height of 2.88 inches and a width of 11 inches. The atmosphere in the furnace is essentially nitrogen, which is continually injected into the furnace at a rate of 100 standard cubic feet per hour (scfh).

The gas jet is positioned as shown in the drawing. Jet angle 9 is 90 degrees. The holes are spaced 0.125 inch apart and each hole has a diameter of 0.015 inch. The gas used in the gas jet is nitrogen.

Horizontal plate 7 is used, the plate having just about the same width as the opening, i.e., so that it can be easily inserted in the opening. Plate 7 is 24 inches in length and is placed so that it extends into the furnace 24 inches.

The flow rate is determined according to the formula set forth above wherein:

A=0.07493 pound per cubic foot
B=0.0279 pound per cubic foot
C=0.0659 pound per cubic foot
$g=4.15\times10^{8}$ hour per hour
$D=1.08\times10^{-4}$ square foot
E=0.92 foot
F=0.242 foot
G=1.56
H=1 atmosphere
J=330° K.

When the door is open, the nitrogen is passed through the gas jet at a flow rate of 47 scfh in accordance with the formula. It is found that the flow rate of air backmixed into the furnace is 4.9 scfh.

When subject process is not used in the same furnace and, further, no gas jet or other flow restricting device is used, on operation of the furnace, it is found that the flow rate of air backmixed into the furnace is 37.3 scfh.

We claim:

1. In a process for preventing the backmixing of gases into a metal heat treating furnace having two ends, one or both of said ends having openings; each of said openings being defined by its dimensions of width and height and having a gas jet positioned in said opening in such a manner that at least part of the gases is prevented from backmixing into the furnace, the improvement comprising preventing substantially all of said gases from backmixing into the furnace by carrying out the following steps:

(a) constructing the gas jet by providing a row of uniformly distributed holes in the wall of a straight tube, said row of holes being about parallel to the hypothetical axis running through the center of the tube from one end of the tube to the other end, the ratio of the distance between any two adjacent holes to the height of the opening being no greater than about 1:6;

(b) positioning the gas jet at about the top, and across the width of each opening, the holes being pointed into the furnace in such a direction that a hypothetical line drawn through the center of each hole from, and perpendicular to, the axis of the gas jet would be at an angle in the range of about 0 degree to about 110 degrees as measured from a hypothetical line corresponding to the height dimension of the opening; and (c) inserting a plate above the gas jet at about the top, and across the width, of at least one opening at about a ninety degree angle to the hypothetical line corresponding to the height dimension of the opening, said plate extending into the furnace a distance at least about equal to the height of the opening; and (d) introducing a gas through each gas jet at a flow rate through said gas jet, which is (i) about equal to or greater than the value determined by the following formula when the furnace has one opening and (ii) about equal to the value determined by the following formula when the furnace has two openings:

$$\sqrt{\frac{(A-B)(g)(D)(E)(F)^2(G)}{C}}\times\frac{H}{1.0}\times\frac{300}{J}$$

wherein:

A=density of ambient air
B=density of furnace gases at the opening for said gas jet
C=density of jet gas
g=acceleration of gravity
D=total area of holes in said gas jet
E=width of said opening
F=height of said opening
G=about 1 to about 5
H=the pressure in number of atmospheres inside the gas jet
J=the temperature in degrees Kelvin inside the gas jet.

2. The process defined in claim 1 wherein the distance is in the range of about 0.1 inch to about 0.6 inch and the angle is in the range of about 45 degrees to about 90 degrees.

* * * * *